United States Patent [19]

Borom

[11] 4,073,662

[45] Feb. 14, 1978

[54] METHOD FOR REMOVING A MAGNESIA DOPED ALUMINA CORE MATERIAL

[75] Inventor: Marcus P. Borom, Schenectady, N.Y.

[73] Assignee: General Electric Company, Schenectady, N.Y.

[21] Appl. No.: 775,761

[22] Filed: Mar. 9, 1977

[51] Int. Cl.[2] ..... C23G 1/14; C01F 7/00

[52] U.S. Cl. ..... 134/2; 134/29; 423/111; 423/131; 423/155; 106/62; 164/131; 164/132

[58] Field of Search ..... 423/111, 119, 131, 155, 423/600; 106/62; 134/2, 29; 164/131, 132

[56] References Cited

U.S. PATENT DOCUMENTS

| | | | |
|---|---|---|---|
| 3,121,026 | 2/1964 | Beigay et al. | 134/29 |
| 3,473,599 | 10/1969 | Lichfield | 164/41 |
| 3,563,711 | 2/1971 | Hammond et al. | 164/132 |
| 3,694,264 | 9/1972 | Weinland et al. | 134/2 |
| 3,722,574 | 3/1973 | Anderson et al. | 164/132 |
| 3,743,692 | 7/1973 | Vinton et al. | 164/132 |

FOREIGN PATENT DOCUMENTS

| | | | |
|---|---|---|---|
| 965,850 | 8/1964 | United Kingdom | 106/62 |

*Primary Examiner*—Herbert T. Carter

*Attorney, Agent, or Firm*—Donald M. Winegar; Joseph T. Cohen; Jerome C. Squillaro

[57] ABSTRACT

Ceramic mold and core materials of magnesia doped alumina are removed from castings by a solution of either KOH or NaOH at elevated temperatures and pressures in an autoclave.

6 Claims, No Drawings

METHOD FOR REMOVING A MAGNESIA DOPED ALUMINA CORE MATERIAL

Rights Granted to the United States of America

The Government of the United States of America has rights in this invention pursuant to Contract No. F33615-76- C-5110 awarded by the Department of the Air Force.

BACKGROUND OF THE INVENTION

1. Field of the Invention

This invention relates to a ceramic material suitable for use in the casting and directional solidification of superalloys and, in particular, to a process for leaching the same from the casting.

2. Description of the Prior Art

The directional solidification of advanced superalloys, such as the eutectic superalloy NiTaC-13, requires casting times and temperatures beyond the capability of conventional silica based molds and cores. New mold and core materials must meet the basic criteria of chemical inertness to the molten alloy. The core, in addition to being chemically inert to the molten alloy, must also be capable of being easily removed from the casting by a method which does not adversely affect the engineering properties of the metal.

It is therefore an object of this invention to provide a material composition which is suitable for use as a core material in the casting and directional solidification of advanced superalloy material and is easily removed from the casting.

Another object of this invention is to provide a magnesia doped alumina ceramic material suitable for use in making cores for casting and directional solidification of advanced superalloys and which can be easily removed from the casting by a leaching process.

A further object of this invention is to provide a method for removing cores made of magnesia doped alumina from the castings of advanced superalloy material.

BRIEF DESCRIPTION OF THE INVENTION

In accordance with the teachings of this invention there is provided a new and improved method for removing a ceramic material from an abutting contact relationship with a casting of an advanced superalloy material. The ceramic material is a magnesia doped alumina wherein the magnesia content is greater than about 1 mole percent but not greater than about 20 mole percent, balance alumina. The microstructure of the magnesia doped alumina is characterized by a matrix comprising an interconnecting network of magnesia doped alumina defining a plurality of interstices in which the material magnesium aluminate spinel is deposited.

The magnesia doped alumina is removed by an autoclave leaching process at an elevated temperature and an elevated pressure. A solution of either KOH or NaOH comprises the leaching solution. The elevated temperature is at least about 200° C and may range up to about 350° C and higher. A preferred temperature for leaching is about 290° C.

The core is easily removed from the casting by an autoclave leaching process employing either KOH or NaOH leaching solutions. The leaching solution attacks the interconnecting alumina network and washes the remainder of undissolved material out of the casting by agitation of the solution and the ongoing chemical reaction.

Advanced superalloys, such as NiTaC-13, are not attacked by the core material or the leaching solutions.

DESCRIPTION OF THE INVENTION

It has been discovered that magnesia doped alumina doped with at least about 1 mole percent magnesia will leach in an autoclave KOH or NaOH solution at rates orders or magnitude greater than that for pure alumina of the same microstructure characterized by the degree of porosity. It is believed that the addition of the divalent alkaline earth cations into the trivalent cation lattice of $Al_2O_3$ introduces lattice defects which enhance the kinetics of the dissolution of alumina.

The magnesia may be present in amounts from about 1 mole percent up to about 30 mole percent. It has been discovered that as the magnesia content decreases, the volume fraction of the magnesia doped alumina phase increases. The magnesia doped alumina phase encases the spinel phase. The spinel phase therefore provides either an interconnected network defining a plurality of interstices in which the magnesia doped phase is found or a dispersion of particles within a matrix of magnesia doped alumina.

When a casting has solidified, the core of magnesia doped alumina is removed by autoclave leaching employing either a KOH or a NaOH solution. A solution of from about 10 weight percent in water up to about 70 weight percent in water has been found to be satisfactory. The autoclave temperature is preferably greater than about 200° C and may range upwards to about 350° C and higher. The autoclave pressure is that which results from the leaching process. Autoclave leaching with a NaOH solution is preferred.

The NaOH or KOH leaching agent attacks the ceramic material of the core by dissolving the magnesia doped alumina of the interconnecting network. The rest of the core material, spinel and any magnesia doped alumina remaining is physically washed out of the core cavity by agitation during the leaching process. Any remaining material may be removed by mechanical agitation before or after removal from the autoclave. Examination of advanced superalloys, such as NiTaC-13, cast with the magnesia doped alumina core indicates no apparent attack on the material.

As the magnesia content decreases to about 5 mole percent, the leaching action increases to a maximum and thereafter decreases. The lower magnesia content has been found to be about 1 mole percent. Below this magnesia content limit, leaching times become too long to be commercially important for specimens having less than 20 percent porosity, where the porosity is not interconnected.

Above about 20 mole percent magnesia, the leaching times again become excessively long so as to preclude possible commercialization at this time. Examination of samples indicate that the magnesia doped alumina network, when magnesia exceeds about 20 mol percent, begins to become discontinuous. Dissolution of the alumina network by the autoclave KOH or NaOH process therefore begins to fall off rapidly. The decrease in dissolution is attributed to the fact that autoclave leaching must occur by intergrannular attack which at a magnesia content of about 25 mole percent is almost an order of magnitude slower than at a 20 mol percent content.

The magnesia doped cores may be prepared in either one of two possible procedures. In one procedure a mechanical mix of magnesia and alumina is prepared. The core is then formed by pressing and sintering at a temperature of from about 1600° C to about 1850° C. In the second procedure, the mix of magnesia and alumina is prepared and calcined at a temperature of 1500° C ± 200° C for about 1 to 4 hours to form a two phase product of spinel and magnesia doped alumina. The calcined product is then crushed and ground to a particle size of from 1 to 40 μm. Suitable cores are then formed by dispensing sufficient powdered calcined material into a core mold, pressing for compaction thereof and sintering at a temperature of from about 1600° C to about 1850° C. Such cores, manufactured in either manner, have achieved excellent usage in casting the advanced superalloy NiTaC-13. They easily withstand elevated temperatures of from 1600° C to about 1800° C for periods up to 30 hours and more.

The resulting NiTaC-13 castings have acceptable surface finishes and the magnesia doped alumina cores were easily removed from the castings by either one of the autoclave KOH or NaOH leaching processes. The KOH and the NaOH had no detrimental effect on the finish or integrity of the superalloy casting.

After the autoclave processing, the casting is removed from the autoclave, washed in water and dried in a warm oven. The casting can now be stored or processed further as required.

I claim as my invention:

1. A method for removing a ceramic core material comprising magnesia doped alumina disposed in an abutting relationship of a casting of an advanced superalloy material, wherein the composition of the ceramic material includes a magnesia content of greater than about 1 mole percent but no greater than about 20 mole percent, balance alumina, and the microstructure of the magnesia doped alumina is characterized by a matrix comprising an interconnecting network of magnesia doped alumina defining a plurality of interstices in which the material magnesium aluminate spinel is deposited, comprising the process steps of (a) placing the casting and the ceramic core material in an autoclave containing a leaching solution selected from the group consisting of a solution of NaOH and a solution of KOH said leaching solution being from about 10 percent by weight to about 70 weight hydroxide and the balance water;

(b) heating the casting, ceramic core material and leaching solution to a temperature of at least about 200° C;

(c) dissolving substantially all of the magnesia doped alumina interconnecting network in the ceramic core material by chemical attack by the leaching solution, and (d) removing at least some of the undissolved ceramic core material from the casting by the solution agitated by the chemical reaction.

2. The method of claim 1 wherein the hydroxide is NaOH.

3. The method of claim 1 wherein the hydroxide is KOH.

4. The method of claim 1 wherein the temperature in the autoclave is about 290° C.

5. The method of claim 4 wherein the hydroxide is NaOH.

6. The method of claim 4 wherein the hydroxide is KOH.

* * * * *

UNITED STATES PATENT AND TRADEMARK OFFICE

CERTIFICATE OF CORRECTION

PATENT NO. : 4,073,662

DATED : February 14, 1978

INVENTOR(S) : Marcus P. Borom

It is certified that error appears in the above-identified patent and that said Letters Patent are hereby corrected as shown below:

Column 4, line 13, after "70", add --percent by--.

Signed and Sealed this

*Third* Day of *October 1978*

[SEAL]

*Attest:*

RUTH C. MASON
*Attesting Officer*

DONALD W. BANNER
*Commissioner of Patents and Trademarks*